United States Patent [19]

Kuehnle et al.

[11] 4,286,031

[45] Aug. 25, 1981

[54] ELECTROSTATIC MULTICOLOR COMPOSITE PRINTING METHOD AND APPARATUS

[75] Inventors: Manfred R. Kuehnle, Lexington; Jurgen Kruse, Acton, both of Mass.

[73] Assignee: Coulter Stork U.S.A., Inc., Chicago, Ill.

[21] Appl. No.: 171,736

[22] Filed: Jul. 24, 1980

Related U.S. Application Data

[63] Continuation of Ser. No. 918,165, Jun. 22, 1978, abandoned.

[51] Int. Cl.[3] ..... G03G 15/16

[52] U.S. Cl. ..... 430/44; 430/47; 430/126; 355/14 D; 355/4; 118/645; 118/651; 101/DIG. 13; 101/216; 101/131

[58] Field of Search ..... 430/126, 44, 47; 355/14 D, 4; 118/651, 645; 101/216, 131, DIG. 13

[56] References Cited

U.S. PATENT DOCUMENTS

| | | | |
|---|---|---|---|
| 2,576,047 | 11/1951 | Schaffert | 118/655 |
| 2,956,487 | 10/1960 | Giaimo | 118/9 |
| 2,986,466 | 5/1961 | Kaprelian | 430/44 |
| 3,368,894 | 2/1968 | Matkan et al. | 96/12 Y |
| 3,690,756 | 9/1972 | Smith | 96/1.2 |
| 3,888,664 | 6/1975 | Carlson et al. | 96/1.4 |
| 4,015,027 | 3/1977 | Buchan et al. | 427/24 |
| 4,120,577 | 10/1978 | Watanabe et al. | 430/45 |
| 4,124,286 | 11/1978 | Barasch | 96/1 R |
| 4,162,843 | 7/1979 | Inoue et al. | 355/4 |
| 4,168,973 | 9/1979 | Simm et al. | 430/47 |

FOREIGN PATENT DOCUMENTS 826611 11/1969 Canada .

*Primary Examiner*—John D. Welsh

*Attorney, Agent, or Firm*—Silverman, Cass & Singer, Ltd.

[57] ABSTRACT

A printing method and apparatus in which an elongate substrate such as a strip of paper, fabric, synthetic resin sheeting, foil or the like is imprinted with a plurality of patterns in different colors to achieve a composite multicolored image.

The apparatus has multiple independent stations through which the substrate is passed, each station having a master sleeve with an image in semipermanent fixed primary toner formed thereon. The image is transferred to the substrate directly from the sleeve or by way of an intermediate transfer roll or blanket as in offset printing.

The master sleeve is charged in light, the toned parts retaining charge by virtue of being dielectric in character, the now charged image is toned with a suitable pigmented secondary toner and this double toned image is pressed against the passing substrate or brought very close to it either directly or through the transfer medium. Through the aid of an electrical field established between the substrate and the sleeve or transfer medium the toner is transferred to the substrate and the sleeve and medium circulate back to pass through the same process of charge, tone and transfer.

The transferred images on the substrate are fixed between or during movement through stations. Information on image density may be fed back to the same or previous stations for change in the bias field conditions or other parameters.

16 Claims, 3 Drawing Figures

ELECTROSTATIC MULTICOLOR COMPOSITE PRINTING METHOD AND APPARATUS

This is a continuation of application Ser. No. 918,165 filed June 22, 1978, now abandoned.

BACKGROUND AND FIELD OF THE INVENTION

The field of the invention comprises printing apparatus and more particularly is concerned with printing apparatus which operates on electrostatic principles rather than upon the conventional principles of graphic art printing as known today.

Color printing is effected today by mixing the colors on the final receptor through the use of multiple registered impressions. For example, a color object or image is photographed through several filters to make color separations in the printed colors comprising cyan, magenta, yellow and black. These separations are made into plates which are mounted in a printing press and the substrate such as paper is passed through the press and impressed with each of the plates in turn.

Various attempts to use electrostatic techniques for multicolor printing are known but for the most part these are complex, expensive and unreliable. The separation of the original master into plates of different basic colors is still normally required and the process contemplates the use of xerography or electrofax techniques for multiple printing.

The invention differs from the prior art in that the images to be printed are formed by electrostatic techniques semipermanently on sleeves that remain so imaged throughout the entire printing run, while in the prior art which uses electrostatic techniques there is a direct transfer or imaging for each example printed.

The invention also differs from other printing presses in that there is a separate station for each color to be printed so that different parameters which may be required for each color may be achieved at the respective stations without interfering with the imprinting of the colors from other stations.

SUMMARY OF THE INVENTION

A printing method in which an elongage substrate is imprinted with a plurality of images of different color pigments in registration to achieve a pattern composed of multiple colors. The substrate is paper, fabric, synthetic resin sheeting, foil or the like.

The method comprises transferring a toned image from a sleeve to the substrate at each of a plurality of transfer stations, the toner or pigment used at each station being of a different color. Electric bias fields are used at each station to assist in the transfer.

Each station is provided with a master sleeve upon which there is provided a semipermanent pattern of the single color component of the eventual composite print which is to be applied at that station. The master sleeve may also comprise the transfer sleeve or the master may apply an image to an intermediate transfer sleeve as in offset printing. The semipermanent toner in either case is required to be dielectric in character. The transfer or secondary toner need not be dielectric in character.

In each case the master can be made in the same manner. The pattern is applied by projection or by laser "writing". In laser "writing" digitized information from a store is used to modulate a laser beam that sweeps the precharged surface of the master sleeve. The resulting latent image is toned and fused. This is normally accomplished while the sleeve is not mounted on the apparatus but can also be effected with the sleeve in place.

Once the master sleeve is in place at its station, its image as transferred to the moving substrate is required to be imprinted in registration with the images from all other stations.

The stations are preferably arranged in alignment and are independent so that different conditions for optimum transfer can obtain at each. Each applied image is fixed after development and before the substrate has moved that image to its following station. The toner, voltages, temperatures and the like at any one station may be different from those same parameters at all others. This arrangement of independent stations provides flexibility in achieving best results.

The master sleeve comprises a belt or cylinder formed from a substrate which carries a photoconductive coating that is inorganic, microcrystalline, has high quantum yield, is transparent and flexible per se, can be very thin—of the order of less than a micron—has high resolution and is capable of accepting a rapid charge. Thicker coatings are feasible.

There can be measurements made of density at any station and the information fed back to the same or previous stations to change the parameters of the printing conditions thereat.

DESCRIPTION OF THE PREFERRED EMBODIMENTS

The printing method of the invention involves the making of a master sleeve upon which the image is carried. The master sleeve rotates preferably in cylindrical form and either contacts the substrate directly in which case it rotates in the same direction as the substrate or the master sleeve serves as a medium through which the secondary toned image on the master sleeve is transferred onto a second sleeve or blanket which in turn is transferred directly to a moving substrate from the second sleeve and indirectly from the master sleeve. In the later case, the peripheral direction of movement of the master sleeve is contra that of the substrate.

One of the important aspects of the invention lies in the apparatus in that the apparatus includes a plurality of stations each of which is independently controlled as to the various parameters required to produce the necessary impression or image on the substrate.

Figure 1:
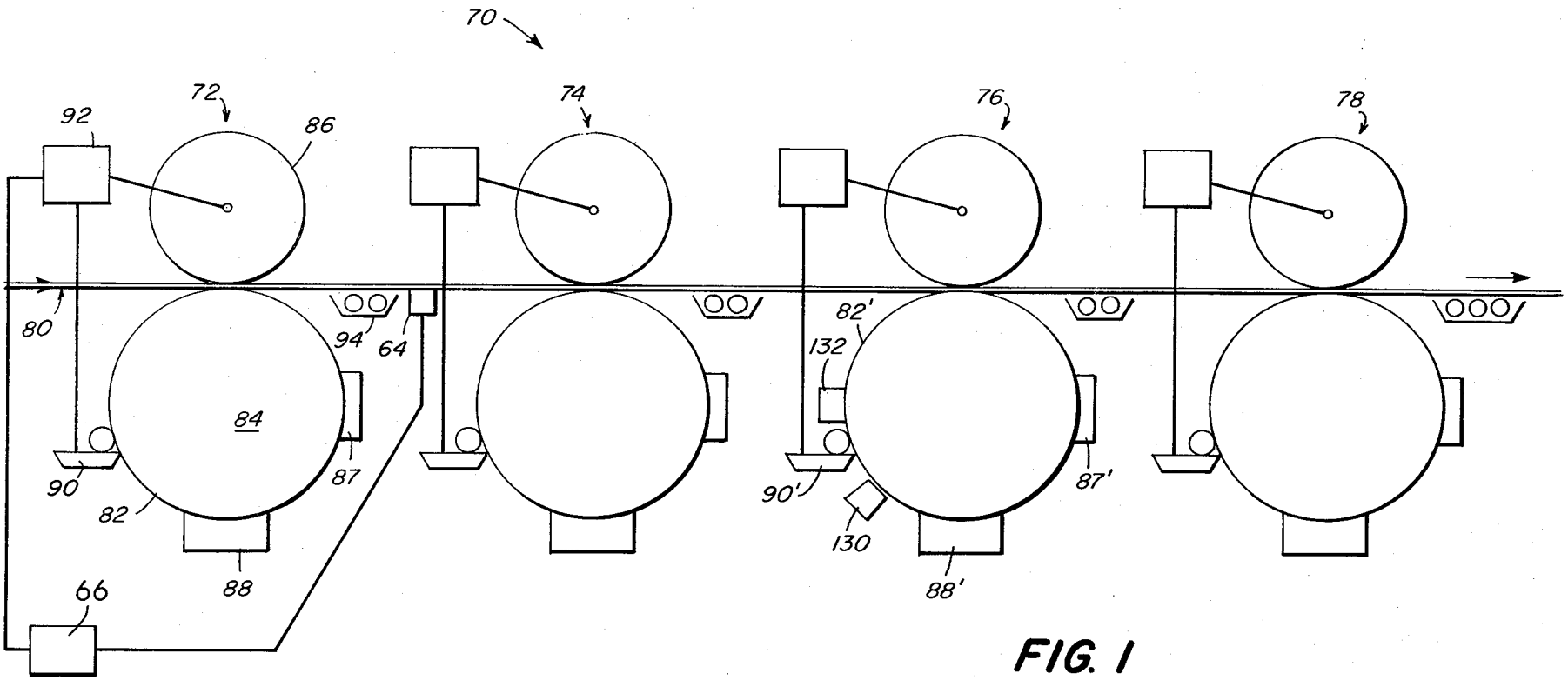
FIG. 1 is a diagrammatic view of apparatus for carrying out the method of the invention and printing composite color images on a moving substrate.

In FIG. 1 there is illustrated a printing apparatus 70 according to the invention which in this case has four stations 72, 74, 76 and 78 it being assumed that the apparatus 70 is to be used for color imprinting on paper.

The substrate 80 passes through apparatus 70 and may move through various rollers, tensioning devices, etc., none of which is shown. At the first station there is a master sleeve 82 which is mounted on a roller 84, the master sleeve 82 in this case being cylindrical although it could be in the form of a belt. There is no need for transparency of the sleeve. Preferably the sleeve 82 comprises a coating of photoconductive material applied to a thin, metal cylinder maintained in its cylindrical condition upon the roller 84 by suitable means.

Figure 2:
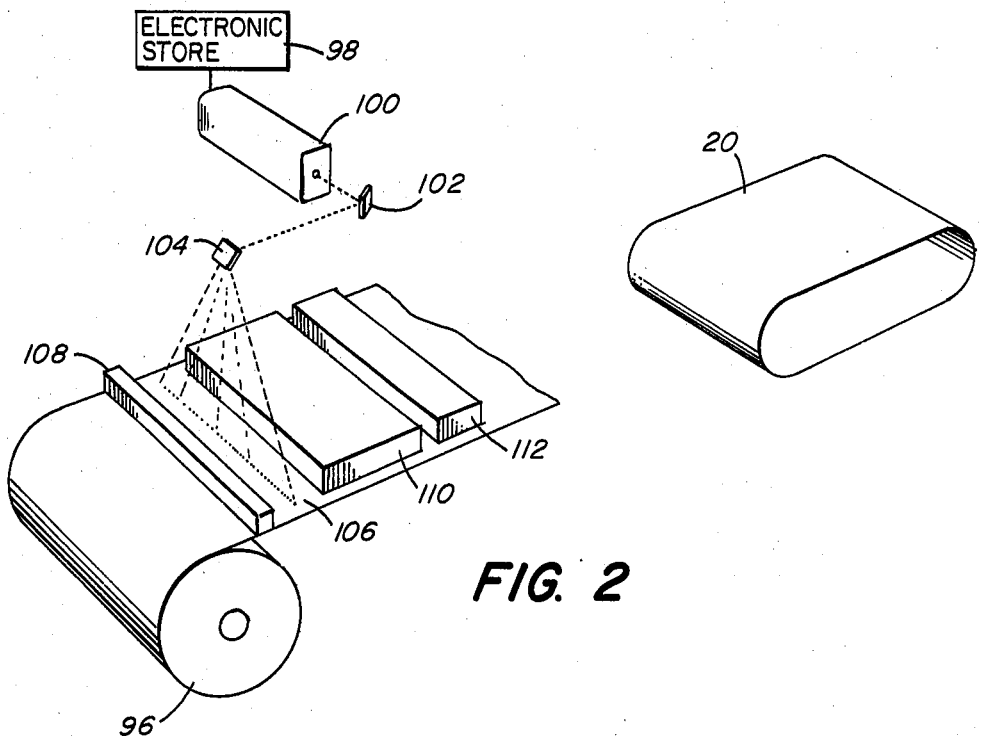
FIG. 2 is a diagrammatic view showing a method of making a master sleeve for use with the invention.
Figure 3:
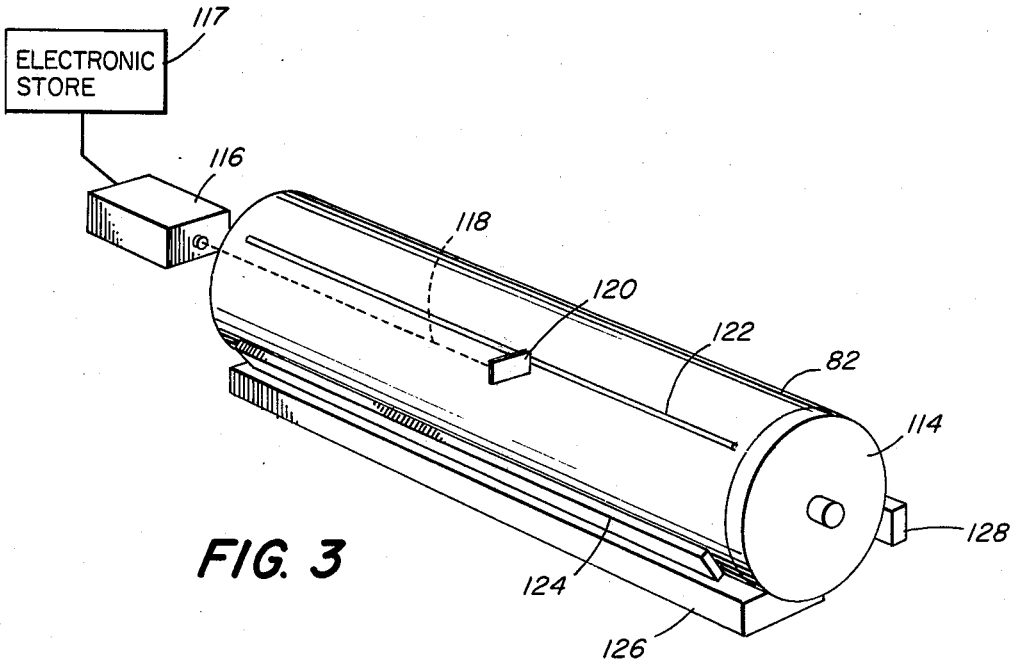
FIG. 3 is another diagrammatic view showing a second method of making a master sleeve for use with the invention.

The sleeve 82 will carry an image preferably in the form of a digital coded color separation which has been applied to the sleeve in a manner to be described especially in connection with FIGS. 2 and 3. At this point it may be said that the sleeve 82 is formed of an electrophotographic material or member comprising a substrate which, if formed of resin such as transparent polyester carries an ohmic layer and a coating of photoconductive material on the outside thereof. If of metal, the photoconductive material is applied directly. The photoconductive material comprises an inorganic compound, preferably cadmium sulfide, which has been sputtered onto the substrate as a microcrystalline, transparent, high quantum yield deposit of the type which is disclosed in U.S. Pat. No. 4,025,339. The method of coating the substrate is also disclosed in that patent.

The master sleeve 82 has been previously imaged in a manner to be described in connection with FIGS. 2 or 3, the image having been toned with a dielectric or primary toner and fused so that it is semipermanently affixed to the exterior of the master sleeve 82. The station also includes a pressure roller 86 which may assist in driving the substrate 80 from left to right and/or may assist in the transfer of the toned imaged from the exterior surface of the master sleeve 82 to the bottom surface of the substrate 80.

In use the imaged master sleeve 82 is charged by any suitable means at 88 and after charging or even at the same time is exposed to light.

As a result of the exposure to light after the sleeve 82 has been charged the charge remains on the dielectric toned parts and leaks off those parts which have not been toned thereby providing a charged image which is then passed to a secondary toning bath 90 where the secondary toned image is now developed. This secondary toned image is passed around by rotation of the roll 84 into engagement with the passing substrate 80 at the point where the roller 86 is juxtaposed. Transfer may be effected either by pressure or by an electric field furnished by the power supply 92 connected to the roller 86 and to the toner bath 90 or to the roller 84. In any event there is a field across the space between which the substrate 80 is moving and this assists in the transfer of secondary toner to the lower surface of the substrate. There may be an intermediate blanket or transfer roll.

After the toned image is applied to the substrate it passes over a heating device 94 at which point the image is fixed.

All of the remaining stations operate in the same way and are constructed in the same way, the difference between them being the parameters of heat, temperature and so on. It has been found that different toners require different voltages, temperatures, etc. so that the use of a sequence of stations operating independently is more likely to give best results. It has even been found that certain cases of transfer require biases of opposite polarity for optimum results.

Information on density may be sensed after each image is applied, for example at 64 which comprises an optical transducer, to a control signal converter 66 from which the bias voltage generated in 92 will be varied for optimum density condition.

When the substrate 80 emerges from the station 78 all four images are compositely applied to the bottom surface thereof, it being assumed that registration is maintained by suitable means which are not shown. From here the substrate 80 may move to slitters, cutters, folders, supply rolls, etc., none of which are shown but presumed to comprise structure using the oncoming substrate.

In FIG. 2 there is shown a roll 96 of the transparent electrophotographic material from which a sleeve is made. This material may be welded together to form a flexible belt which is indicated at 20 either before or after the image has been applied. The belt 20 is capable of being formed into sleeve 82 and mounted cylindrically. The image may be projected onto the belt 20 optically, this being done by charging followed by imaging, toning with dielectric toner and fixing. It is preferred however, that the image be applied in a digital fashion so that there is no need for a screen and no problem deriving from optical projection means.

A suitable multi-colored pattern is scanned and its colors separated and digitized into bits which may be stored in an electronic store. This is indicated at 98. The store is then used to modulate a low power laser, such as for example a helium-neon laser 100. The laser projects its modulated beam by way of reflecting means 102 and 104 onto the surface of the electrophotographic material of the roll 96 at 106 as this material is being unrolled. By suitable drives the reflecting means 102 and 104 are capable of correcting and compensating for the conversion from the continuous flow of bits to application to a surface as the beam swings back and forth. The material is first charged at 108, imaged at 106, toned at 110 and fixed at 112. The resulting image is now semipermanently fixed and the length of material may be cut from the roll 96 and formed into the sleeve 20 in the form of a belt by welding the ends together. The belt may be in sheet form and clamped to a mandrel.

In FIG. 3 there is illustrated apparatus which can be used to make a sleeve directly as a cylinder such as shown at 82 in FIG. 1. The sleeve 82 is in the form of a thin cylinder of metal or the like having a coating of the photoconductive material described mounted on a mandrel 114 which is driven. The same type of laser 116 as shown in FIG. 3 at 100 fed from an electric store 117 directs a modulated beam of light 118 composed of digitized bits to a travelling mirror 120 mounted on a suitable driven guide rod 122 so that the digitized bits are properly laid down upon the surface of the sleeve 82 to produce the desired image representing a single color of a composite. A corona device 124 is arranged to charge the surface and a toning device 126 is provided to tone it after the image has been laid down. At 128 one can see a representation of a toner fixing device which is on the opposite side of the view in FIG. 3 semipermanently to affix the dielectric toned image to the master cylinder 82.

After the master cylinder has been toned and the image fixed it is removed from the mandrel 114 and installed in an apparatus such as 72.

In the operation of the apparatus 72 after the secondary toner has been transferred to the substrate 80 any toner which remains on the surface of the sleeve 82 may be removed by suitable cleaning apparatus such as shown at 87.

It is feasible to have the sleeve 82 imaged on line, that is, permanently secured in place in the apparatus 72 but provided with means for applying the image from the store and fixing the same for use. Thus, on station 76 there is illustrated a block 130 at which location the same functions are performed as performed by the laser 116 and the moving mirror 120 of FIG. 3. The charging means 88' charges the sleeve 82', and the toning apparatus 90' accomplishes the toning, all of this being done in a series of revolutions before the substrate 80 is brought against the surface of the sleeve 82'. The cleaning apparatus 87' is not used in this preliminary operation but a fixing device is required at 132 after toning.

Once the image has been semipermanently applied to the sleeve 82' the apparatus 130 and 132 are rendered inoperative and the toning device 90' then works in conjunction with the charging device 88' and the cleaning device 87'.

Reference made to the fact that the images are semipermanent means that they can be removed by suitable chemicals which will not affect the photoconductive surface. For example, even fused images of dielectric toner can be removed by acetone or in some instances warm ethyl or methyl alcohol.

The dielectric toned images need not be pigmented. The secondary toned images are required to be pigmented.

Dielectric toner means toner which when fixed is highly insulating so that charge will not leak off.

Various modifications of the invention are capable of being achieved without departing from the spirit or scope of the invention as defined in the appended claims.

What is desired to secure by Letters Patent of the United States is:

1. Apparatus for printing a composite pattern repeatedly upon a continuously moving substrate, said pattern being made up of registered impressions of different images having different colors, said apparatus comprising:

A. a plurality of uniformly spaced image printing stations, each being substantially similar in construction and adapted to produce a different color impression successively upon a substrate, B. means for moving an elongate substrate linearly through the apparatus from station to station, C. each station comprising i. a rotating master sleeve, said sleeve having an image thereon in the form of a component of a composite image, a. said sleeve being an electrophotographic member including an outer coating of photoconductive material, b. said image being a fixed dielectric toner image which has been electrostatically formed on said outer coating, ii. means for charging and toning said fixed dielectric toner image with a secondary toner to achieve a secondary toned image of said fixed toner image which is developed but not fixed, iii. means for transferring the secondary toned image to a surface of the substrate while the substrate is moving through said station, iv. means for fixing the transferred image to said substrate surface before said substrate moves to the next following station to achieve an imprinted impression of a certain color, v. and means for removing from said sleeve any excess toner which is not transferred to said substrate surface if any had remained, D. the master sleeve at each station carrying a different image, the stations being arranged continuously successively to repeat the imprinting superimposed in registration on the substrate as it passes through the apparatus, each sleeve being rotatable at a peripheral speed the same as the linear speed of the substrate moving through each station whereby the transferred image on the substrate is in registry with the immediately prior applied transferred and fixed image whereby to achieve a continuous series of the same composite image along the substrate as it leaves the apparatus.

2. The apparatus as claimed in claim 1 and means at each station for effecting said transfer directly from the sleeve to the surface of the substrate as it passes through each said station.

3. The apparatus as claimed in claim 2 in which the sleeve is in the form of a cylinder, each cylinder having substantially the same diameter.

4. The apparatus as claimed in claim 2 in which the means for effecting transfer comprise a pressure roller at said position on the surface opposite the substrate from said sleeve.

5. The apparatus as claimed in claim 2 in which the means for effecting transfer include electric field producing means for establishing an electric bias between the sleeve and the substrate effective to move the unfixed secondary toner from sleeve to substrate.

6. The apparatus as claimed in claim 2 in which the means for removing excess toner comprise cleaning apparatus adjacent the sleeve after the position where the transfer is effected.

7. The apparatus as claimed in claim 2 in which the fixing means comprise a heater adjacent the surface of the substrate following the location in the station where the transfer is effected.

8. The apparatus as claimed in claim 3 in which the cylinder is formed of thin metal and the coating of photoconductive material is adhered directly to said metal.

9. The apparatus as claimed in claim 2 in which the charging of the fixed toner image is carried out in ambient light.

10. The apparatus as claimed in claim 5 in which the field producing means comprise an electric power supply, a roller disposed at said sleeve but on the opposite side of said substrate and engaging the same, and said power supply is electrically coupled to said sleeve and roller.

11. The apparatus as claimed in claim 1 in which means are provided to sense the density of said impression produced by a station and generate a signal for controlling at least one of the parameters of transfer of said station to maintain the said density at a predetermined value.

12. Method of printing composite color images on an elongate substrate wherein the colored images are produced repeatedly and spaced along the substrate and each is composed of a plurality of impressions of different color which comprises:

A. providing a plurality of printing stations, each station being arranged to produce an impression of a different color, B. providing at each station a master sleeve of electrophotographic material and rotating the sleeve continuously while simultaneously moving the substrate through the station, the peripheral speed of the sleeve being the same as the linear speed of the substrate, each master sleeve carrying a different semipermanent fixed dielectric toner image thereon capable of being reproduced as the said impression, the master sleeve at each station being identical in size and configuration to the master sleeves at all stations C. forming a secondary unfixed toner image at each station upon the fixed toner image during each said master sleeve rotation, D. transferring the secondary unfixed toner image to the surface of said substrate from each master sleeve as the substrate passes said each station successively, E. fixing each transferred unfixed toner image on said substrate as the substrate moves and before the substrate reaches the next station, whereby the impressions from each station after the first station are applied successively to said substrate superposed and in registration.

13. The method as claimed in claim 12 in which the secondary unfixed toner image is transferred directly from the said master sleeve to said substrate.

14. The method as claimed in claim 12 in which the density of the fixed toner image of said substrate is measured after fixing and such measurement used to control the transfer.

15. The method as claimed in claim 12 in which the transfer to said substrate is at least aided electrically.

16. The method as claimed in claim 12 in which the image on the master sleeve is formed prior to use by digitizing a pattern and storing same, modulating a laser beam with the digitized information from said store and writing on said master sleeve, toning said sleeve and fixing the resulting developed image.

* * * * *